US009605625B2

(12) United States Patent
Balsdon et al.

(10) Patent No.: US 9,605,625 B2
(45) Date of Patent: Mar. 28, 2017

(54) HIGH PERFORMANCE VACUUM VENTURI PUMP

(71) Applicant: Continental Automotive Systems, Inc., Auburn Hills, MI (US)

(72) Inventors: David William Balsdon, Chatham (CA); Binjamin Dominick Manton Williams, Chatham (CA); David Rene Forgeron, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 50 days.

(21) Appl. No.: 14/542,985

(22) Filed: Nov. 17, 2014

(65) Prior Publication Data

US 2015/0176542 A1 Jun. 25, 2015

Related U.S. Application Data

(60) Provisional application No. 61/918,310, filed on Dec. 19, 2013.

(51) Int. Cl.
*B01F 5/04* (2006.01)
*F02M 25/08* (2006.01)

(52) U.S. Cl.
CPC ..... *F02M 25/0836* (2013.01); *F02M 25/089* (2013.01); *Y10T 137/87587* (2015.04)

(58) Field of Classification Search
CPC ..... F02M 25/089; F02M 25/0836; Y10T 137/87587
USPC ..... 137/888, 891; 417/151, 194, 198
See application file for complete search history.

(56) References Cited

U.S. PATENT DOCUMENTS 3,915,184 A 10/1975 Galles
5,863,128 A * 1/1999 Mazzei ..... B01F 5/0415 137/888
6,210,123 B1 4/2001 Wittrisch
6,364,625 B1 4/2002 Sertier
7,886,727 B2 2/2011 Ulrey et al.
7,954,507 B2 * 6/2011 Boticki ..... B01F 5/0413 137/218

(Continued)

FOREIGN PATENT DOCUMENTS

DE 2425111 A 5/1974
DE 69814654 T2 4/2004

(Continued)

OTHER PUBLICATIONS

DE 102011086938 A1 English Machine Translation.

*Primary Examiner* — Umashankar Venkatesan

(57) ABSTRACT

A venturi valve assembly, having a flow tube, an upper port integrally formed with flow tube, a flow cavity disposed within the flow tube, an inlet formed as part of the flow tube such that the inlet forms a part of the flow cavity, an outlet formed as part of the flow tube such that the outlet forms a part of the flow cavity, and a venturi nozzle disposed in the flow tube. Pressurized air flows into the flow cavity from the inlet such that the pressurized air flows around the venturi nozzle. Purge vapor flows into the flow cavity from the upper port, and the flow rate of the pressurized air is increased after flowing around the venturi nozzle, increasing the flow of the purge vapor after the purge vapor is mixed with the pressurized air in the flow tube.

16 Claims, 5 Drawing Sheets

(56) References Cited

U.S. PATENT DOCUMENTS

| | | | | |
|---|---|---|---|---|
| 2004/0050438 | A1* | 3/2004 | Haas | F04F 5/10 137/888 |
| 2005/0011498 | A1* | 1/2005 | Yoshiki | F02M 25/08 123/520 |
| 2010/0294251 | A1 | 11/2010 | Makino et al. | |

FOREIGN PATENT DOCUMENTS

| | | | |
|---|---|---|---|
| DE | 102010029150 | A1 | 12/2010 |
| DE | 102011086938 | A1 | 5/2013 |
| JP | S59101961 | U | 7/1984 |
| JP | S63109 | A | 1/1988 |
| JP | 2005030324 | A | 2/2005 |
| JP | 2008196458 | A | 8/2008 |
| JP | 2011144697 | A | 7/2011 |

* cited by examiner

HIGH PERFORMANCE VACUUM VENTURI PUMP

CROSS-REFERENCE TO RELATED APPLICATIONS

This application claims the benefit of U.S. Provisional Application No. 61/918,310 filed Dec. 19, 2013. The disclosure of the above application is incorporated herein by reference.

FIELD OF THE INVENTION

The invention relates generally to optimization of air flow and purge vapor in an air flow system of a vehicle.

BACKGROUND OF THE INVENTION

Turbochargers are commonly used to increase the power of a vehicle engine. Turbochargers include a turbine which generates pressurized air, and the air is forced into the engine to increase combustion pressure, and therefore increase the power generated by the engine.

With some tubocharging systems, a portion of the pressurized air is bled off to create a vacuum and induce flow of purge vapor. The vacuum created is used as part of a purge system, where the purge system directs purge vapors from a fuel tank through various conduits to redirect the vapors into the intake manifold of the engine, and burn off these vapors through combustion.

Current turbo purge systems use a venturi vacuum generator (such as a vacuum pump) to allow purge of the evaporative system while the turbocharger is activated (i.e., the intake manifold is under positive pressure). This vacuum pump often uses significant amounts of the pressurized air created by the turbocharger, thereby reducing the power increase created by the turbocharger. However, it is desirable to use as much of the pressurized air as possible to maximize the power increase to the engine. In order to limit the amount of turbo air running through the pump, and temporarily maximize engine power, a turbo bypass switching valve (BSV) has been used to alter the amount of flow going to the vacuum pump (venturi nozzle).

However, this approach still reduces the efficiency of the turbocharger by diverting some of the pressurized air to the vacuum pump, instead of the intake manifold of the engine. It is therefore desirable to maximize the efficiency of the vacuum pump, and minimize the amount of airflow diverted from the turbocharger.

SUMMARY OF THE INVENTION

The present invention is a valve assembly used as part of a vapor purge system, which uses a vacuum created by a venturi nozzle to direct purge vapor from a canister through the purge system, and into an intake manifold.

In one embodiment, the present invention is a venturi valve assembly, having a flow tube, an upper port integrally formed with flow tube, a flow cavity disposed within the flow tube, an inlet formed as part of the flow tube such that the inlet forms a part of the flow cavity, an outlet formed as part of the flow tube such that the outlet forms a part of the flow cavity, and a venturi nozzle disposed in the flow tube. Pressurized air flows into the flow cavity from the inlet such that the pressurized air flows around the venturi nozzle. Purge vapor flows into the flow cavity from the upper port, and the flow rate of the pressurized air is increased after flowing around the venturi nozzle, increasing the flow of the purge vapor after the purge vapor is mixed with the pressurized air in the flow tube. The purge vapor flows from the upper port into an area of the flow cavity downstream of the venturi nozzle.

The venturi nozzle includes a pin portion having a front section and a back section, at least one fin, which in one embodiment may be a plurality of fins, and connected to the front section of the pin portion such that the fin supports the pin portion in the flow tube, and a cap portion connected to the front section of the pin. Part of the back surface of the cap portion is in contact with the front surface of the flow tube when the venturi nozzle is positioned in the flow tube.

The venturi valve assembly also includes a first diameter area and a second diameter area formed as part of the inlet. The the first diameter area receives the pressurized air from a conduit, and the second diameter area substantially surrounds the back section of the pin portion.

In one embodiment, the second diameter area is at least 0.005 inches larger than the diameter of the back section of the pin portion.

The fin includes an outer flange portion connected to the cap portion, and an inner flange portion connected to the front section of the pin portion and the outer flange portion. The outer flange portion and the inner flange portion are in contact with the inner surface of the tapered inlet to locate the venturi nozzle in the flow tube.

In one embodiment, the back section of the pin portion has a larger diameter than the front section of the pin portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
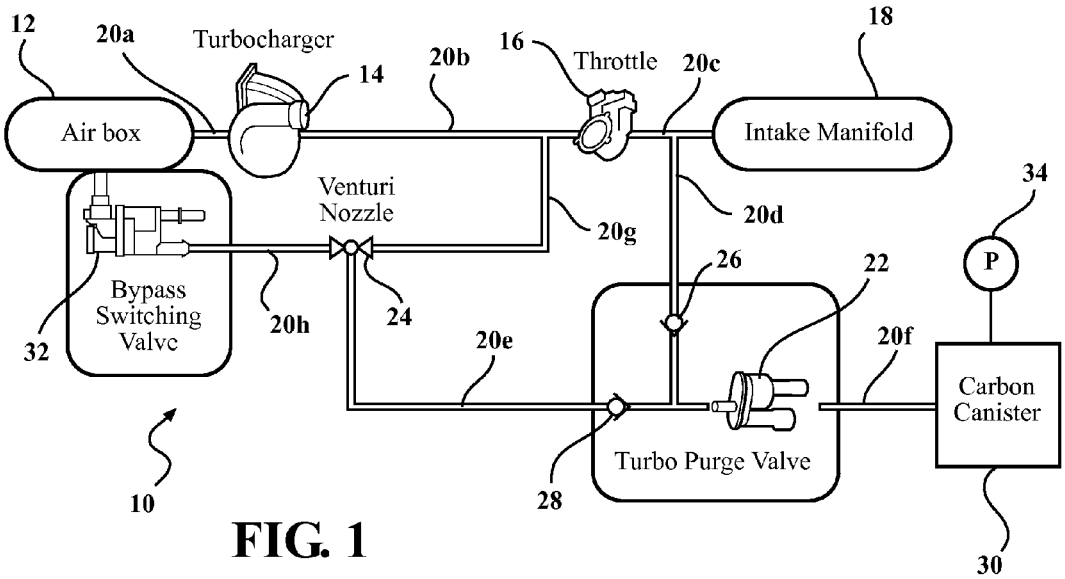
FIG. 1 is a diagram of an airflow system for a vehicle having a venturi valve assembly, according to embodiments of the present invention.
Figure 2:
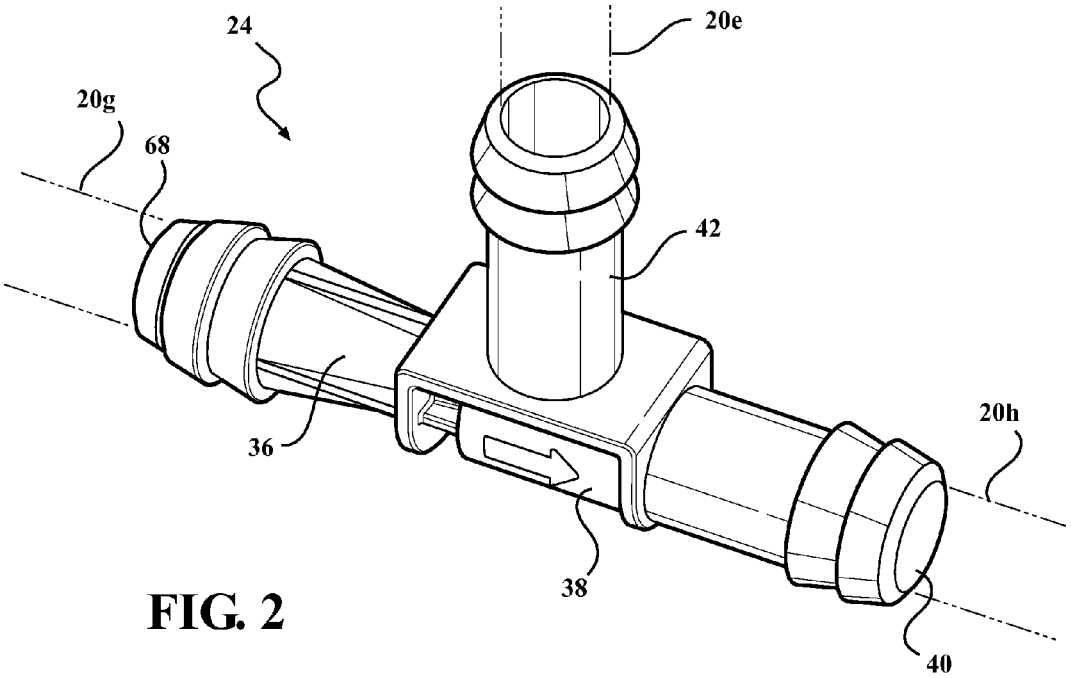
FIG. 2 is a perspective view of a venturi valve assembly, according to embodiments of the present invention.
Figure 3:
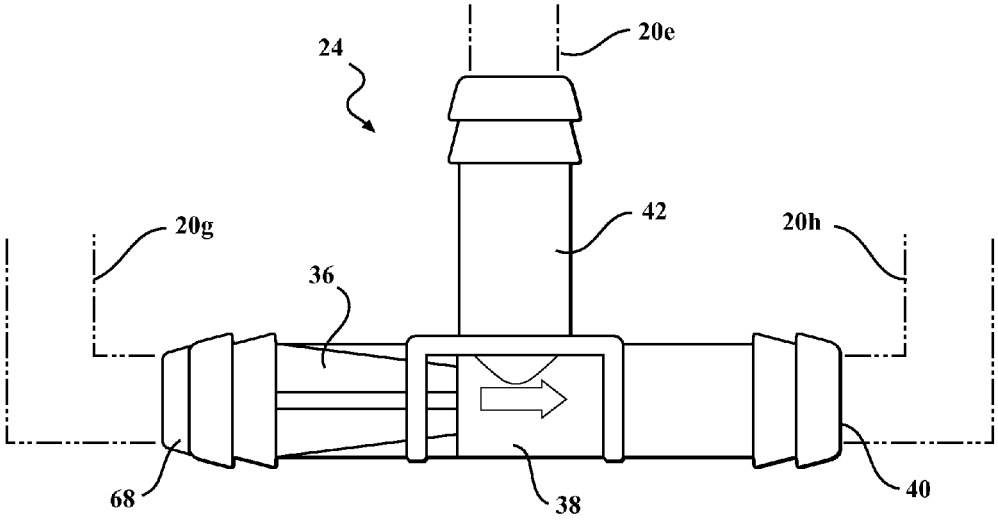
FIG. 3 is a side view of a venturi valve assembly, according to embodiments of the present invention.
Figure 4:
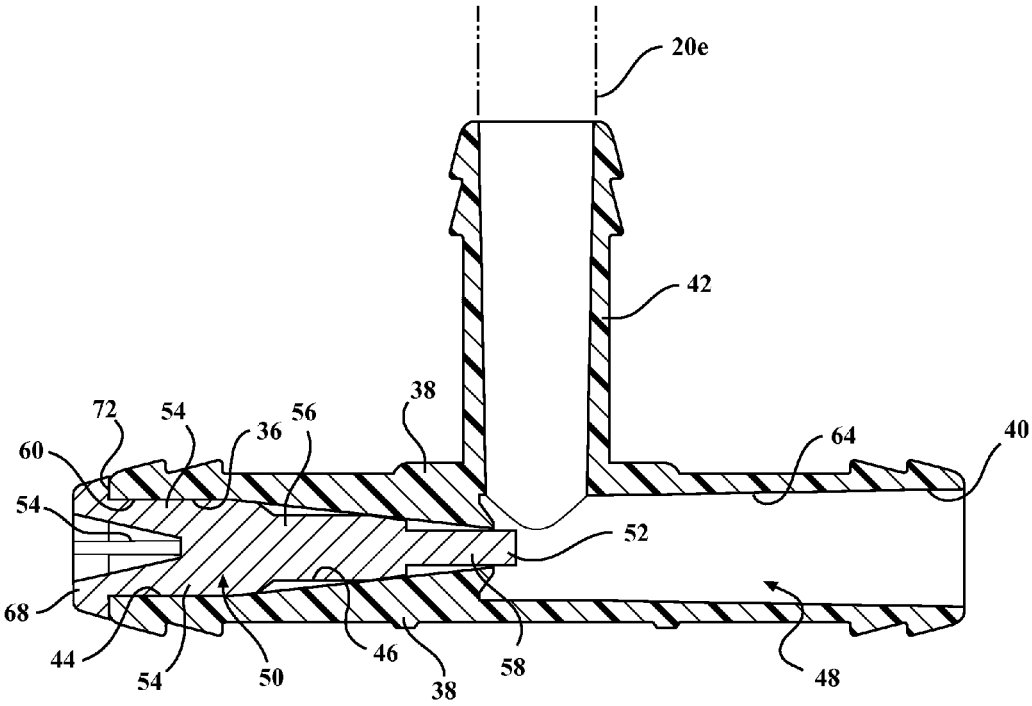
FIG. 4 is a sectional side view of a venturi valve assembly, according to embodiments of the present invention.
Figure 5:
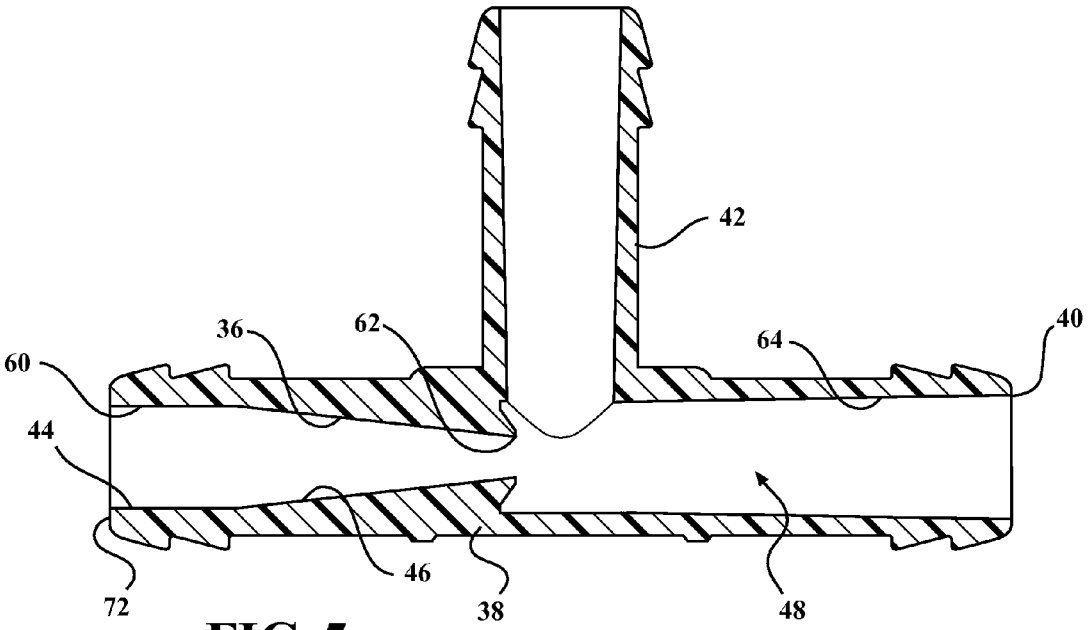
FIG. 5 is a sectional side view of a venturi valve assembly, with the venturi nozzle removed, according to embodiments of the present invention.
Figure 6:
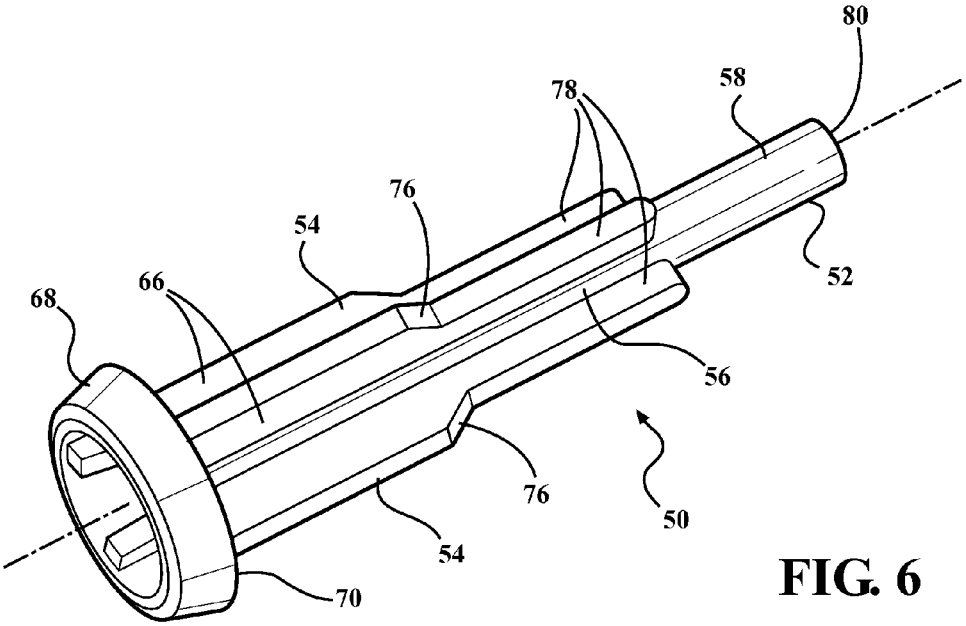
FIG. 6 is a perspective view of a venturi nozzle which is part of a venturi valve assembly, according to embodiments of the present invention.
Figure 7:
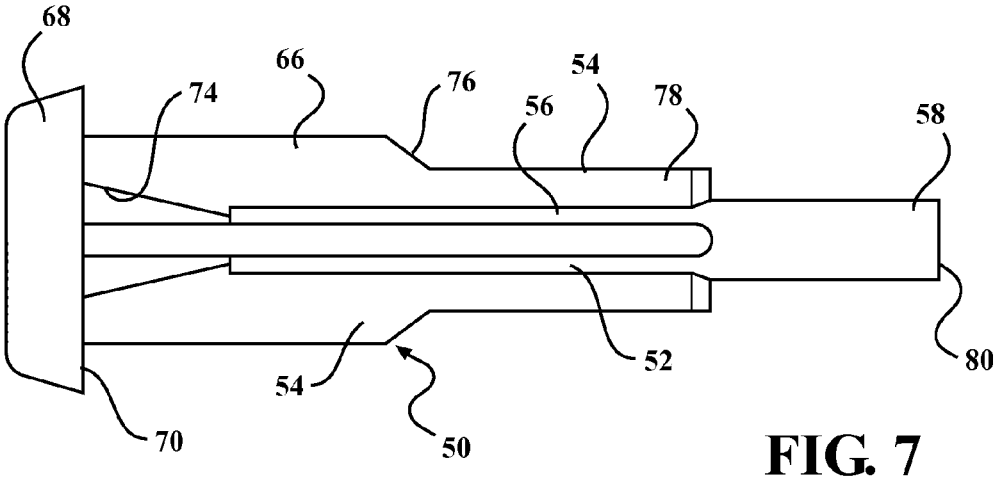
FIG. 7 is a side view of a venturi nozzle which is part of a venturi valve assembly, according to embodiments of the present invention.
Figure 8:
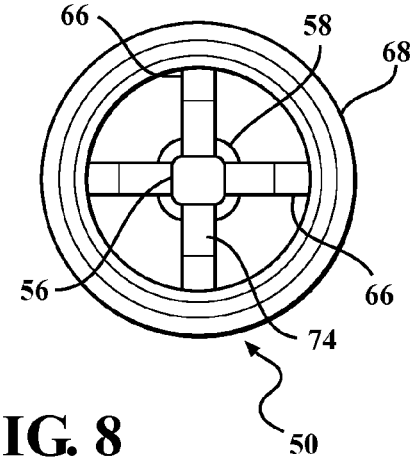
FIG. 8 is a front view of a venturi nozzle which is part of a venturi valve assembly, according to embodiments of the present invention.
Figure 9:
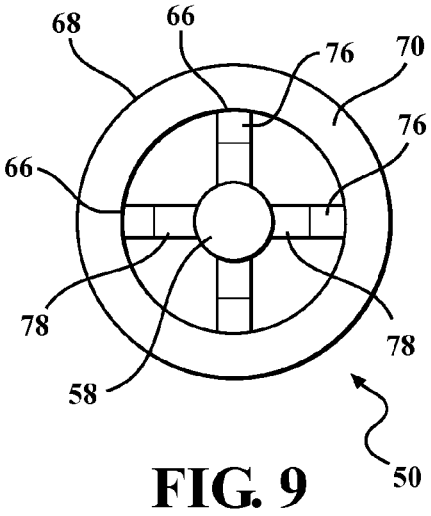
FIG. 9 is rear view of a venturi nozzle which is part of a venturi valve assembly, according to embodiments of the present invention.

A diagram of an airflow system of a vehicle having a venturi pump according to the present invention is shown generally in FIG. 1 at 10. The system 10 includes an air box 12 which intakes air from the atmosphere. Located downstream of and in fluid communication with the air box 12 is a turbocharger unit 14, and located downstream of and in fluid communication with the turbocharger unit 14 is a throttle assembly 16. The throttle assembly 16 controls the amount of air flow into an intake manifold 18, which is part of an engine.

A plurality of conduits also provides fluid communication between the various components. Air flows through the conduits between the various components, and the direction of airflow through the conduits varies, depending on the mode of operation of each component. More specifically, there is a first conduit 20*a* providing fluid communication between the air box 12 and the turbocharger 14, a second conduit 20*b* providing fluid communication between the turbocharger 14 and the throttle assembly 16, and there is also a third conduit 20*c* providing fluid communication between the throttle assembly 16 and the intake manifold 18.

A fourth conduit 20*d* is in fluid communication with the third conduit 20*c* and a fifth conduit 20*e*, and the fifth conduit 20*e* places a turbo purge valve 22 in fluid communication with a venturi valve assembly 24. There is a first check valve 26 disposed in the fourth conduit 20*d*, and a second check valve 28 disposed in the fifth conduit 20*e*. There is also a carbon canister 30 in fluid communication with the turbo purge valve 22 through the use of a sixth conduit 20*f*.

A seventh conduit 20*g* provides fluid communication between the venturi valve assembly 24 and the second conduit 20*b*, such that pressurized air is able to flow from the second conduit 20*b*, through the seventh conduit 20*g* and to the venturi valve assembly 24. An eighth conduit 20*h* provides fluid communication between the venturi valve assembly 24 and a bypass switching valve 32, and the bypass switching valve 32 is mounted on the air box 12.

In operation, when the turbocharger 14 is not active, air flows through the air box 12, the turbocharger 14, the throttle 16, and into the intake manifold 18. The intake manifold 18 creates a vacuum drawing air into the intake manifold 18. This vacuum also causes the first check valve 26 to open, which draws purge vapor from the canister 30 through the turbo purge valve 22, and into the intake manifold 18. This same vacuum also causes the second check valve 28 to close.

When the turbocharger 14 is activated, air flowing into the turbocharger 14 from the air box 12 is pressurized, the pressurized air flows through the throttle 16, and the air then flows into the intake manifold 18. In this mode of operation, the manifold 18 is operating under positive pressure.

The valve 32 is able to change between open and closed positions, and anywhere in between. When the valve 32 is open, and pressurized air is passing through the seventh conduit 20*g*, the venturi valve assembly 24, and the eighth conduit 20*h*, this also creates a vacuum, where air is drawn from the venturi valve assembly 24, such that the air passes through the valve 32 and into the air box 12. This vaccum also opens the second check valve 28, and purge vapor from the canister 30 passes through the turbo purge valve 22 (when the valve 22 is open), through the venturi valve assembly 24, through the bypass switching valve 32, and the air box 12. The purge vapor then flows through the turbocharger 14, the throttle 16, and into the intake manifold 18.

When the valve 32 is closed, no vacuum is created, and substantially all of the air pressurized by the turbocharger 14 passes through the throttle 16 and into the intake manifold 18. Because the vacuum created (i.e., the vaccum which causes the second check valve 28 to open, as described above) depends on whether the valve 32 is closed or opened, the valve 32 is also used to perform certain on-board diagnostic (OBD) functions.

When the turbocharger 14 is generating pressurized air, the valve 32 is open, and purge vapor is passing through the purge valve 22, some level of vaccum should be detectable in the canister 30 by a pressure sensor 34. By closing the valve 32, flow through the venturi valve assembly 24 is reduced, producing less vacuum, and a change in pressure in the canister 30, as detected by the sensor 34.

As mentioned above, when the turbocharger 14 is activated and generating pressurized air, and the valve 32 is open, a portion of the pressurized air flows through the seventh conduit 20*g* and into the venturi valve assembly 24. More specifically, the pressurized air flows from the seventh conduit 20*g* into an inlet 36 of the valve assembly 24. The inlet 36 is part of a flow tube 38, and the flow tube 38 also has an outlet 40. Integrally formed with the flow tube 38 is an upper port 42, and the fifth conduit 20*e* is connected to the upper port 42, as shown in FIGS. 2-5. The outlet 40 of the flow tube 38 is in fluid communication with the eighth conduit 20*h*, and a flow cavity, shown generally at 48, inside the flow tube 38. The inlet 36 and the upper port 42 are also in fluid communication with the flow cavity 48. Disposed in part of the flow tube 38 is a venturi nozzle, shown generally at 50. The nozzle 50 includes a pin portion 52 mounted within the flow cavity 48 though the use of support fins 54. In this embodiment, there are several support fins 54 shown in FIGS. 4 and 6-9, however, it is within the scope of the invention that in alternate embodiments, one fin 54 may be used, or several fins 54 may be used.

The pin portion 52 is generally cylindrical in shape, and the front section 56 of the pin portion 52 is integrally formed with the fins 54. The pin portion 52 is mounted in the inlet 36, and the back section 58 of the pin portion 52 is also at least partially disposed in the flow cavity 48 in proximity to the upper port 42, best seen in FIG. 4. The back section 58 includes a back surface 80, and the back surface 80 of the pin portion 52 is substantially flat. The inlet 36 has a first inner surface 44, and a second inner surface 46. The first inner surface 44 is the portion of the inlet 36 having a first, or largest diameter area 60, and is connected to the seventh conduit 20*g*. The portion of the inlet 36 having the second inner surface 46 is tapered, and substantially surrounds the venturi nozzle 50. The second, or smallest diameter area 62 of the inlet 36 is in proximity to the back section 58 of the pin portion 52. The outlet 40 has an inner surface 64 which has a constant diameter, and the outlet 40 is connected to the eighth conduit 20*h*. The tapered shape of the second inner surface 46 of the inlet 36, the shape of the fins 54, and the shape of the pin portion 52 cause a pressure drop across the pin portion 52, and increases the flow rate of the pressurized air in the venturi valve assembly 10.

Each fin 54 includes an outer flange portion 66 integrally formed with a cap portion 68. The back surface 70 of the cap portion 68 is in contact with the front surface 72 of the flow tube 38, to position the nozzle 50 in the flow tube 38. The outer flange portion 66 also includes an angled inner surface 74 which extends from the cap portion 68 to the front section 56 of the pin portion 52. Each fin 54 also includes an angled outer surface 76 formed between the outer flange portion 66 and an inner flange portion 78. Each fin 54 is constructed in substantially the same way, and since in this embodiment there are four fins 54, the fins 54 are spaced equally apart around the front section 56 pin portion 52. The back section 58 of the pin portion 52 (the areas of the pin portion 52 where the fins 54 are not mounted) has a larger diameter compared to the front section 56 of the pin portion 52.

The air flow through the flow tube 38 flows around the pin portion 52. The flow rate of the pressurized air flowing through the flow tube 38 is increased because of the shape of the taper of the inlet 36, which also reduces the pressure, such that the pressure of the pressurized air is less in the smallest diameter area 62 compared to the largest diameter area 60. The more vacuum desired, the larger the amount of pressurized air from the turbocharger 14 is needed. However, the more air that is diverted away from the turbocharger 14, the lower the amount of pressurized air that is delivered to the intake manifold 18 through the throttle 16. It is also desirable to transfer as much purge vapor as possible from the canister 30 as well. The pin portion 52 and the shape of the inlet 36 and outlet 40 increase the efficiency of the venturi nozzle 50. The ratio of pressurized air (i.e., turbo flow) flowing into the inlet 36 vs. the amount of purge vapor (i.e., purge flow) flowing into the upper port 42 defines a coefficient of purge (COP). The COP is the flow rate of purge vapor divided by the flow rate of pressurized air from the turbocharger, and it is desirable to have as high of a COP as possible.

The desired COP in this embodiment is achieved not only through the tapered shape of the second inner surface 46 of the inlet 36, the shape of the fins 54, and the shape of the pin portion 52, but also because of the location of the nozzle 50. The nozzle 50 in this embodiment is located in the area of the flow tube 38 which is upstream of where the purge vapor enters the flow tube 38 from the upper port 42, this also reduces the pressure and increases the speed of the air flow through the flow tube 38, creating more vacuum in the flow tube 38, while using a smaller amount of pressurized air from the turbocharger 14, therefore drawing a greater amount of purge vapor from the upper port 42.

The smallest diameter area 62 of the inlet 36 is generally 0.005-0.010 inches larger than the outer diameter of the back section 58 of the pin portion 52, and the smallest diameter area 62 of the inlet 36 is preferably about 0.005 inches larger than the outer diameter of the back section 58 of the pin portion 52. While it was described above that the fins 54 may be spaced equally apart, it is within the scope of the invention that in other embodiments, the fins 54 may be spaced apart unequally, and the nozzle 50 may also be rotated clockwise or counterclockwise when looking at FIG. 8 or 9, while still maintaining the desired difference in diameter between the smallest diameter area 62 of the inlet 36 and the outer diameter of the back section 58 of the pin portion 52.

Figure 10:
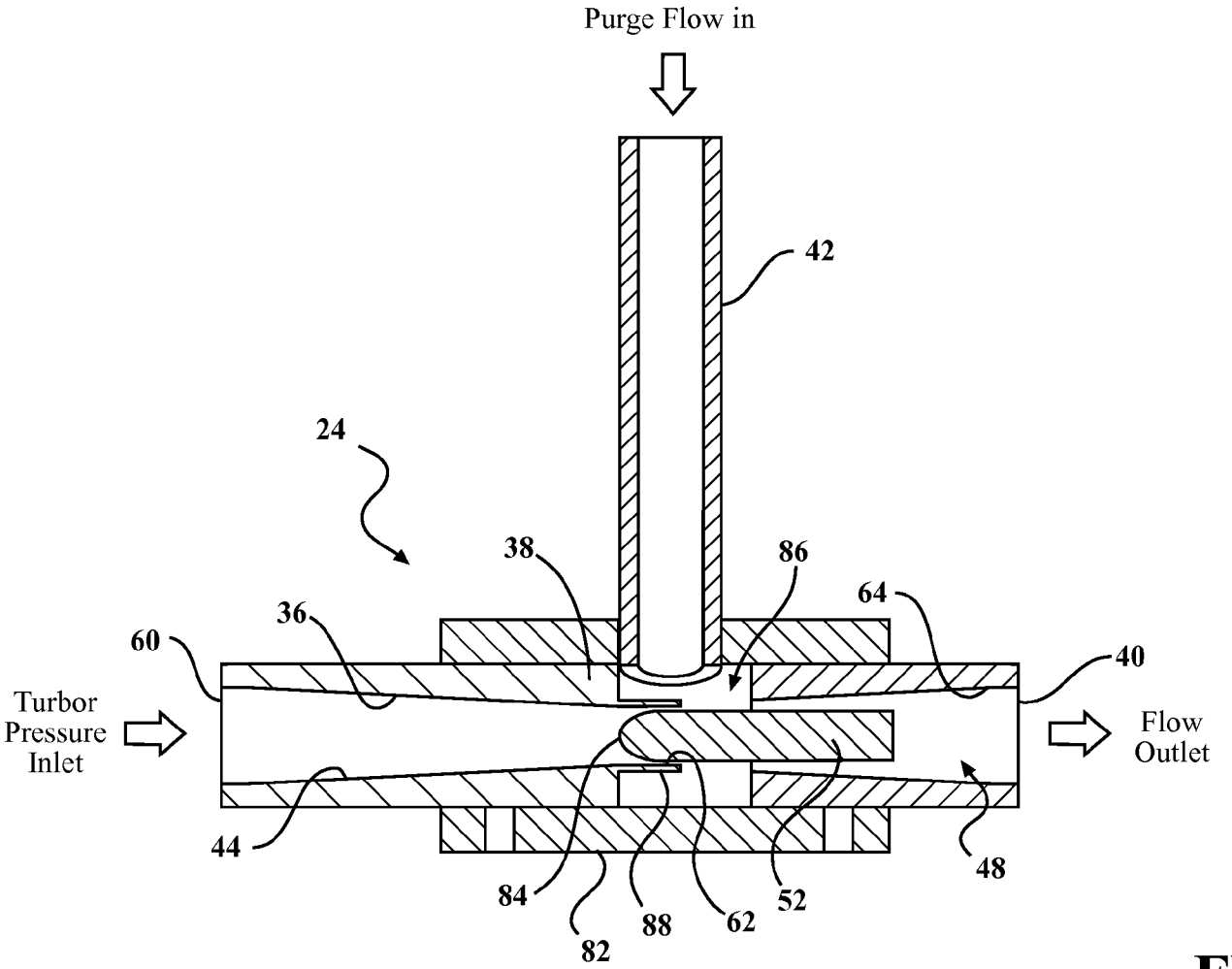
FIG. 10 is a sectional a sectional side view of a venturi valve assembly, according to an alternate embodiment of the present invention.

An alternate embodiment of the present invention is shown in FIG. 10, with like numbers referring to like elements. In this embodiment however, the inner surface 64 of the outlet 40 is tapered, part of the pin portion 52 is disposed in the inlet 36, and part of the pin portion 52 is located in the outlet 40.

The valve assembly 24 in this embodiment also includes a housing 82, and the flow tube 38 is mounted within the housing 82, and part of the upper port 42 extends through the housing 82 as shown in FIG. 10. The pin portion 52 in this embodiment has a single diameter. The pin portion 52 includes a semi-spherical area 84, which is surrounded by part of the second inner surface 46 of the inlet 36. The smallest diameter area 62 of the inlet 36 is in proximity to the outer surface of the pin portion 52. Part of the tapered surface 46 of the inlet 36 forms a thin-walled section 88, and the thin-walled section 88 extends into a cavity, shown generally at 86, which is located in the flow tube 38 between the tapered surfaces 46,64 of the inlet 36 and the outlet 40. The difference between the inner diameter of the thin-walled section 88 and the outer diameter of the pin portion 52 in this embodiment is generally between 0.005-0.010 inches, and is preferably 0.005 inches.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a venturi valve assembly, including:

a flow cavity;

an inlet, a portion of the inlet forming a portion of the flow cavity;

at least one inner surface being part of the inlet, the at least one inner surface being tapered;

a venturi nozzle disposed within the flow cavity such that at least a portion of the venturi nozzle is in contact with the inner surface;

an upper port;

a flow tube integrally formed with the upper port, the flow cavity formed as part of the flow tube, and the venturi nozzle is located in the flow tube;

a pin portion;

at least one fin integrally formed with the pin portion;

a cap portion connected to the at least one fin, the at least one fin and the cap portion position the pin portion in the flow tube;

a front section, and the at least one fin integrally formed with the front section;

a back section connected to the front section, the back section is larger in diameter than the front section;

an outer flange connected to the cap portion; and an inner flange portion connected to the front section of the pin portion, and the outer flange portion and the inner flange portion are in contact with the inner surface of the flow tube to position the venturi nozzle in the flow tube;

wherein pressurized air flows through the flow cavity, and around the venturi nozzle such that the flow rate of the pressurized air increases, and after the pressurized air flows around the venturi nozzle, the pressurized air is mixed with purge vapor after the pressurized air flows around the pin portion, and the purge vapor enters the flow tube from the upper port in an area of the flow tube downstream of the venturi nozzle.

2. The apparatus of claim 1, further comprising:

a back surface formed as part of the cap portion; and a front surface formed as part of the flow tube;

wherein the back surface of the cap portion is in contact with the front surface of the flow tube when the venturi nozzle is disposed within the flow cavity.

3. The apparatus of claim 1, further comprising:

a large diameter area formed as part of the inlet; and a small diameter area formed as part of the inlet;

wherein the large diameter area is connected to a conduit and receives the pressurized air, and the small diameter area is in proximity to the back section of the pin portion.

4. The apparatus of claim 3, wherein the diameter of the small diameter area is between 0.005-0.010 inches larger than the diameter of the back section.

5. The apparatus of claim 1, further comprising an outlet, a portion of the outlet forming a part of the flow cavity such that the outlet is in fluid communication with the inlet, and the pressurized air and purge vapor are mixed when passing through the outlet.

6. A venturi valve assembly, comprising: a flow tube;

a flow cavity disposed within the flow tube; a venturi nozzle disposed in the flow cavity;

a tapered inlet formed as part of the flow tube, a portion of the venturi nozzle surrounded by and in contact with the tapered inlet; and an outlet formed as part of the flow tube such that the outlet is in fluid communication with the tapered inlet; a pin portion;

at least one fin connected to the pin portion such that the at least one fin supports the pin portion, locating the venturi nozzle in the tapered inlet;

a large diameter area formed as part of the tapered inlet, the large diameter area being connected to a conduit and receives pressurized air;

a small diameter area formed as part of the tapered inlet, the small diameter area being in proximity to the pin portion;

a front section, the at least one fin integrally formed with the front section; and a back section connected to the front section, the small diameter area being located in proximity to the back section of the pin portion, the back section of the in portion has a larger diameter than the front section of the pin portion;

wherein pressurized air flows into the flow cavity from the tapered inlet such that the pressurized air flows around the venturi nozzle, and the flow rate of the pressurized air is increased after flowing around the venturi nozzle, increasing the flow of purge vapor after the purge vapor is mixed with the pressurized air after the pressurized air flows around the pin portion in the flow cavity in an area of the flow cavity downstream from the venturi nozzle.

7. The venturi valve assembly of claim 6, further comprising:

a cap portion connected to the front section of the pin portion;

a back surface formed as part of the cap portion; and a front surface formed as part of the flow tube;

wherein the at least one fin and the cap portion position the pin portion in the flow tube, and the back surface of the cap portion is in contact with the front surface of the flow tube when the venturi nozzle is disposed within the flow cavity.

8. The venturi valve assembly of claim 6, wherein the small diameter area of the tapered inlet is at least 0.005 inches larger than the diameter of the back section of the pin portion.

9. The venturi valve assembly of claim 6, the at least one fin further comprising:

an outer flange portion connected to the cap portion; and an inner flange portion connected to the front section of the pin portion and the outer flange portion;

wherein the outer flange portion and the inner flange portion are in contact with the inner surface of the tapered inlet to locate the venturi nozzle in the flow tube.

10. The venturi valve assembly of claim 6, wherein a portion of the outlet forms part of the flow cavity, and the pressurized air and purge vapor are mixed when passing through the outlet.

11. The venturi valve assembly of claim 6, further comprising:

an upper port;

wherein the purge vapor flows from the upper port into an area of the flow cavity downstream of the venturi nozzle.

12. A venturi valve assembly, comprising:

a flow tube;

an upper port integrally formed with flow tube;

a flow cavity disposed within the flow tube;

an inlet formed as part of the flow tube such that the inlet forms a part of the flow cavity;

at least one inner surface being part of the inlet, the at least one inner surface being tapered;

an outlet formed as part of the flow tube such that the outlet forms a part of the flow cavity;

a venturi nozzle disposed in the flow tube, such that at least a portion of the venturi nozzle is in contact with the at least one inner surface;

a pin portion having a front section and a back section;

at least one fin connected to the front section of the pin portion such that the at least one fin supports the pin portion in the flow tube; and a cap portion connected to the front section of the pin, part of the back surface of the cap portion being in contact with the front surface of the flow tube when the venturi nozzle is positioned in the flow tube, and the back section of the pin portion has a larger diameter than the front section of the pin portion;

wherein pressurized air flows into the flow cavity from the inlet such that the pressurized air flows around the venturi nozzle, and purge vapor flows into the flow cavity from the upper port, and the flow rate of the pressurized air is increased after flowing around the venturi nozzle, increasing the flow of the purge vapor after the purge vapor is mixed with the pressurized air in the flow tube.

13. The venturi valve assembly of claim 12, further comprising:

a first diameter area formed as part of the inlet; and a second diameter area formed as part of the inlet;

wherein the first diameter area receives the pressurized air from a conduit, and the second diameter area substantially surrounds the back section of the pin portion.

14. The venturi valve assembly of claim 13, wherein the second diameter area is at least 0.005 inches larger than the diameter of the back section of the pin portion.

15. The venturi valve assembly of claim 12, the at least one fin further comprising:

an outer flange portion connected to the cap portion; and an inner flange portion connected to the front section of the pin portion and the outer flange portion;

wherein the outer flange portion and the inner flange portion are in contact with the inner surface of the tapered inlet to locate the venturi nozzle in the flow tube.

16. The venturi valve assembly of claim 12, wherein the purge vapor flows from the upper port into an area of the flow cavity downstream of the venturi nozzle.

* * * * *